United States Patent [19]

Davies et al.

[11] 4,452,057

[45] Jun. 5, 1984

[54] SHOE MACHINE

[75] Inventors: John Davies, Syston; Graham J. Mansfield, Oadby; Kingsley J. Tutt, Birstall; Frederick J. Graveling, Agleston, all of England

[73] Assignee: USM Corporation, Farmington, Conn.

[21] Appl. No.: 438,520

[22] Filed: Nov. 1, 1982

[30] Foreign Application Priority Data

Nov. 13, 1981 [GB] United Kingdom ..... 8134214

[51] Int. Cl.[3] ..... C14B 1/44

[52] U.S. Cl. ..... 69/6.5

[58] Field of Search ..... 69/6.5

[56] References Cited

U.S. PATENT DOCUMENTS

| | | | |
|---|---|---|---|
| 3,233,438 | 2/1966 | Hansen et al. | 69/6.5 |
| 3,831,405 | 8/1974 | Vornberger | 69/6.5 |
| 4,090,378 | 5/1978 | Sommer | 69/6.5 |

*Primary Examiner*—Patrick D. Lawson

*Attorney, Agent, or Firm*—Donald N. Halgren

[57] ABSTRACT

A computer-controlled machine for progressively roughing marginal portions of shoe bottoms comprises a tool carrier on which two rotary roughing brushes (168) are carried side-by-side, and a shoe support (18) between which and the tool carrier relative movement takes place lengthwise, widthwise and heightwise of the shoe bottom. Each tool (168) is mounted so as to "float" heightwise in relation to the tool carrier, resilient means (175) being provided for urging each tool independently downwardly towards the shoe support (18). In this way the pressure applied by each tool to the shoe bottom in the operation of the machine can be controlled and/or regulated. For effecting relative movement between tool carrier and shoe support, numerically controlled motors are provided, operating in response to a programmed instruction. Such instruction can be made using the machine in a path-determining mode. The machine also comprises sensing means for sensing a defined heightwise position of the tool (168) in the path-determining mode of the machine, and the co-ordinate axis values for each selected position of tool carrier and shoe support are digitized, for each point, in relation to such defined heightwise position of the tool relative to the tool carrier. Similarly, the tool is maintained in a defined heightwise position in relation to the tool carrier during any brush grinding operation.

19 Claims, 2 Drawing Figures

SHOE MACHINE

BACKGROUND OF THE INVENTION (1) Field of the Invention

This invention is concerned with a machine suitable for operating progressively along marginal portions of shoe bottoms, comprising a shoe support, a tool carrier, means for effecting relative movement, both lengthwise and widthwise of the bottom of a shoe supported by the shoe support, between the shoe support and the tool carrier, and means for controlling the heightwise position of the tool carrier relative to the shoe support, as relative lengthwise and widthwise movement is caused to take place therebetween, so that, in an operating mode of the machine, the tool carrier can follow a predetermined path, determined according to the contour of the shoe bottom being operated upon, relative to the shoe support, and a tool carried by the tool carrier can thus be caused to operate progressively along a marginal portion of the bottom of a shoe supported by the shoe support, wherein the tool is mounted on the tool carrier for limited movement relative thereto in a direction extending heightwise relative to the shoe support.

(2) Prior Art

One such machine is disclosed in U.K. patent specification No. 1,071,761. In this machine a three-dimensional template is located in a fixed relationship with the bottom of a shoe supported by the shoe support and the shoe support is caused to move lengthwise of the shoe bottom to carry the bottom of a shoe supported thereby past two tools each supported by a tool carrier, each tool carrier having associated therewith template following means which engage with opposite side portions of the template and thus cause the tools to be moved widthwise and heightwise of the path of movement of the shoe support, as the shoe support is thus moved. Furthermore, in said machine each tool is mounted for pivotal movement about an axis extending widthwise of the shoe bottom stop means being provided for limiting the downward movement of each tool towards the shoe bottom.

In using said machine the three-dimensional template, selected to suit the shoe bottom being operated upon, thus guides the tools, arranged in tandem relationship, along opposite side portions of the shoe bottom during relative lengthwise movement between the shoe support and tool carrier, any irregularities in the shoe bottom, as compared with the contour of the template, being accommodated by the facility for pivotal movement of the tool on the carrier. A disadvantage of this arrangement, however, resides in that a different template is required for each style and size of shoe, and indeed in each style and size, separate templates are required for left and right shoes. Bearing in mind that a shoe factory may well be processing upwards of a dozen styles of shoe, in all the sizes, at any given time, this requirement for individual templates for each style, size and hand clearly renders the use of such a machine unattractive, not least because of the problems of template storage.

The shoe bottom contour is of course a relatively complex one, and thus the use of a three-dimensional template is advantageous to the extent that it can be relatively easily reproduced direct from the shoe bottom, without the need for any complicated calculations. Because the problems referred to above are considered to outweight this one advantage of manufacture, however, there has been a move away from such three-dimensional templates: see e.g. U.K. Pat. No. 1,137,254, in which flat (i.e. two-dimensional) templates are used.

This change from three-dimensional templates has meant that the machine can itself be used in the manufacture of templates, the arrangement being such that, with a blank template carried by the template supporting means, a tool is moved relative to the shoe bottom by the operator, along a path determined by him, and an associated scribing tool, replacing the template follower, is caused to track over the surface of the blank template and score an appropriate line thereon. The template can thereafter be cut along the line to provide the desired shape. Such a procedure is also referred to in U.K. patent specification No. 1,137,254.

Such a procedure can be readily applied in the machine described in the last-mentioned patent specification, since there is no control of the heightwise position of the tool, other than by engagement with the shoe bottom.

It is the object of the present invention to provide an improved machine suitable for operating progressively along marginal portions of shoe bottoms, wherein the tool carrier is caused to follow a predetermined path not only lengthwise and widthwise but also heightwise in relation to the shoe support, the tool is mounted on the tool carrier for heightwise movement relative thereto, thus to accommodate any irregularities in the shoe bottom being operated upon as compared with the predetermined path, and further means is provided for determining the path of the tool carrier in the machine.

The invention thus provides a machine suitable for operating progressively along marginal portions of shoe bottoms, comprising a shoe support, a tool carrier, means for effecting relative movement, both lengthwise and widthwise of the bottom of a shoe supported by the shoe support, between the shoe support and the tool carrier, and means for controlling the heightwise position of the tool carrier relative to the shoe support, as relative lengthwise and widthwise movement is caused to take place therebetween, so that, in an operating mode of the machine, the tool carrier can follow a predetermined path, determined according to the contour of the shoe bottom being operated upon, relative to the shoe support, and a tool carried by the tool carrier can thus be caused to operate progressively along a marginal portion of the bottom of a shoe supported by the shoe support, wherein the tool is mounted on the tool carrier for limited movement relative thereto, in a direction extending heightwise relative to the shoe support, characterized in that the means for effecting relative lengthwise and widthwise movement between the shoe support and tool carrier comprises first and second numerically controlled motors (as herein defined) and the means for controlling the heightwise position of the tool carrier relative to the shoe support comprises a third numerically controlled motor (as herein defined), each such motor operating under the control of computer control means by which drive signals are generated and supplied to said motors in accordance with a programmed instruction, including digitized co-ordinate axis values, using three co-ordinate axes, for a plurality of selected points along the marginal portion of the bottom of the or a similar shoe, in that path-determining means is provided which is operable in a path-determining mode of the machine, and which comprises a manually operable control device for causing relative movement to take place along said three co-ordinate axes between the shoe support and tool carrier to bring them to successive selected points along the marginal portion of the bottom of a shoe supported by the shoe support, and means for digitizing, and storing in digitized form, the co-ordinate axis values of each such selected point, and further in that resilient means is provided for urging the tool to move relative to the tool carrier in a direction extending heightwise relative to the shoe support into a defined heightwise position in relation to the tool carrier and sensing means is also provided, operable in the path-determining mode of the machine, for sensing when the tool is in said defined heightwise position.

The term "numerically controlled motor" where used herein is to be understood as indicating a motor the operation of which is controlled by control signals supplied thereto in accordance with stored information appropriate to a desired operation. Examples of such motors are stepping motors and d.c. servomotors.

By providing such a control arrangement, displacing the three-dimensional template, the problems of storage of the latter are significantly minimized. Of course, it is still necessary for the digitized information to be stored, but this presents no significant problem in terms of space. Furthermore, by simple reversing and grading programs, which can be provided in the computer control means, from one set of digitized information each size of shoe in a given style can be accommodated and also left and right shoes in said style. Furthermore, by using the machine for determining the path of the tool, although the tool is mounted on the tool carrier for limited movement relative thereto heightwise of the shoe support, nevertheless by the sensing means being provided no problem arises in the path-determining mode of the machine from the tool being incorrectly placed heightwise in relation to the shoe bottom.

Preferably in the machine in accordance with the invention the resilient means is effective to urge the tool in a direction towards the shoe support. Furthermore, it is desirable that the pressure applied to a shoe bottom by the tool, as it operates progressively along a marginal portion of such shoe bottom, is controlled. To this end, therefore, in accordance with the invention, preferably also, in the operating mode of the machine, the tool is displaced, against the action of the resilient means, out of its defined heightwise position in relation to the tool carrier and thus the presser applied thereby is controlled by the resilient means.

One manner in which such displacement can be achieved would be for the co-ordinate axis values for each selected point to be digitized, in the path-determining mode of the machine, with the tool in its defined heightwise position, while in the operating mode of the machine the pre-determined path of the tool carrier relative to the shoe support is transposed in relation to, and towards, the shoe support. Where the tool is a roughing tool, however, such a system of transposition may be undesirable in that, at the start of the operating cycle, the tool would, as it approaches the shoe bottom but is not yet in engagement therewith, be disposed in its defined heightwise position and thus the shoe bottom engaging portion of its operating surface would be disposed below the level of the shoe bottom, with a result that the shoe upper may be roughed above its feather line as the tool engages the side of the shoe and is moved over its edge onto the shoe bottom.

Consequently in a preferred embodiment, in the path-determining mode, each selected point is determined in relation to the defined heightwise position of the tool, the tool carrier being thereafter moved heightwise through a distance to displace the tool from its defined heightwise position prior to the co-ordinate axis values of the selected point being digitized. As a further feature of such a procedure, such displacement is arranged not to take place at the first selected point, so that, e.g. in the case of a roughing tool, the tool is positioned directly at the height of the shoe bottom at the start of roughing.

Such displacement may be effected under the direct control of the operator. Alternatively, the procedure lends itself to automatic execution.

The resilient means may be fluid pressure operated and may further comprise variable pressure regulating means, the arrangement being such that the pressure applied to a shoe bottom by the tool is thus controlled by the pressure regulating means. In such a case, furthermore, means may be provided whereby the pressure controlled by said regulating means, and thus also the pressure applied as aforesaid to the shoe bottom, can be varied during the progressive operation of the tool along the marginal portion of the shoe bottom as aforesaid. In this way, where e.g. the shoe upper requires different treatments along its length, e.g. in the case of a roughing operation where the material of the upper is of different properties along its length, changes in pressure may be programmed into the computer control means at the same time as digitizing takes place.

The sensing means referred to may be arranged to prevent digitizing from taking place unless the tool is in its defined heightwise position. Alternatively, and preferably, however, the sensing means causes indicator means to be operated whereby a signal is provided, visible by the operator, when the tool is in its defined heightwise position and when moved therefrom. In this way, the operator can more readily ascertain when the tool has moved into its defined position. The sensing means may be of any conventional type, e.g. fluidic.

In one embodiment of the invention, the tool is a rotary tool, more especially a radial wire roughing brush, said tool being carried on an arm which is supported on the tool carrier for pivotal movement about an axis extending generally lengthwise of the shoe bottom and on which the resilient means is arranged to act, belt drive means being provided for rotating the tool, including a pulley mounted for rotation about said axis. By this arrangement, the heightwise movement of the tool in no way affects, or is affected by, the means for effecting rotation thereof.

With such a tool, furthermore, grinding means may be provided, as is conventional, whereby the operating surface of the tool can be ground. In such a case, means is also provided for shifting the defined heightwise position of the tool in relation to the tool carrier through a pre-determined distance each time a grinding operation takes place. The shifting means may conveniently also comprise a numerically controlled motor (as herein defined).

For ensuring that, during the grinding operation, the tool is located in a known position (which is necessary where the tool operating surface is maintained at a datum), the tool may be urged into its said defined heightwise position, to which end increased pressure is applied to and acts upon the resilient means, such pressure being sufficient to resist any counter-pressure as the grinding means is urged against the operating surface of the tool. Alternatively, the tool may be moved during the grinding operation into a second defined heightwise position spaced from said first-mentioned defined heightwise position. This can be readily achieved in accordance with the invention in that the end of the arm remote from its axis of pivot is connected to the tool carrier by a pin-and-slot connection, which thus defines the first-mentioned and second defined heightwise positions of the tool in relation to the tool carrier.

Preferably the tool carrier is mounted for pivotal movement about an axis extending widthwise of the shoe bottom, the tool being so arranged that said axis extends tangentially, or substantially so, to the shoe bottom engaging portion of its operating surface, when the tool is in contact with the shoe bottom being operated upon. Furthermore, preferably means, including a numerically controlled motor (as herein defined), is provided for effecting pivotal movement of the tool carrier about said axis as the tool is caused to operate progressively along the marginal portion of the bottom of a shoe, said motor also operating under the control of computer control means in response to drive signals generated and supplied thereto by said computer control means in accordance with a programmed instruction.

BRIEF DESCRIPTION OF THE DRAWINGS

There now follows a detailed description, to be read with reference to the accompanying drawings, of one machine in accordance with the invention, which machine has been selected for description merely by way of exemplification of the invention and not by way of limitation thereof.

In the accompanying drawings.

DESCRIPTION OF THE PREFERRED EMBODIMENT

Figure 1:
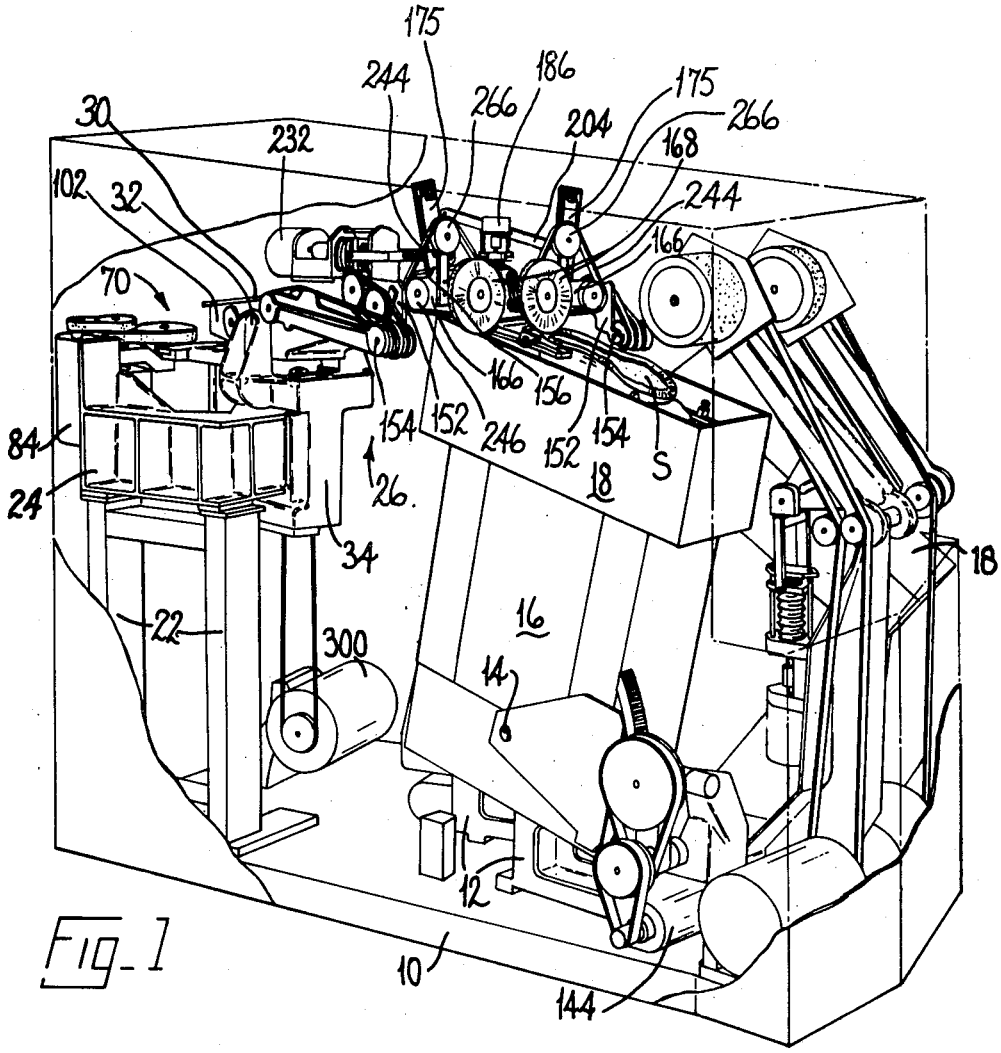
FIG. 1 is a left hand perspective view of the machine in accordance with the invention.

The machine now to be described is generally similar, except as hereinafter described, to the machine described in our co-pending EPC Application No. 81302395.9, being a machine for use in performing a roughing operation progressively along marginal portions of shoe bottoms. The machine thus comprises a base 10 supporting on brackets 12 two pivot shafts 14, each in turn carrying a support 16 for a shoe support 18. Each shoe support 18 can support a shoe S, bottom uppermost, with the toe end thereof facing towards the front of the machine, i.e. towards the operator. At its rear, the base 10 supports a support column structure 22 carrying a casting on which tool supporting means generally designated 26 is carried, the tool supporting means comprises a bifurcated arm 30 supported, for pivotal movement about a horizontal axis, between upstanding lugs 32 forming part of a support casting 34, the latter casting itself being supported for pivotal movement about a vertical axis. Thus, by moving either of the shoe supports 18 on its associated shaft 14, and further by effecting pivotal movement of the arm 30 about said horizontal and vertical axes, relative lengthwise, heightwise and widthwise movement is effected between the tool supporting means 26 and the shoe support 18.

For effecting such movement of each shoe support 18, furthermore, a first numerically controlled motor, constituted by a stepping motor 144, is provided, arranged to act through a drive arrangement 142. Similarly, for effecting movement of the arm 30 about its vertical axis a second numerically controlled motor (as herein defined), constituted by a second stepping motor 84 is provided, acting through a drive arrangement generally designated 70. Again, for effecting movement of the tool supporting arm 30 about its horizontal axis, a third numerically controlled (as herein defined), constituted by a stepping motor (not shown, but identified by reference numeral 122 in the aforementioned EPC Patent Specification), is provided, acting on a rearwardly extending portion 102 of the arm 30.

At its forward end, the arm 30 supports a transversely extending bridge member at opposite ends of which are provided forwardly projecting arms 152, between which is carried, on fulcrum pin 154, a generally U-shaped tool carrier comprising a cross-beam 156, two bevelled gear housings 158, arranged one at either end of the cross-beam, and two forwardly projecting arms 160. Projecting forwardly from each housing 158 is a shaft 164 on which an inwardly extending transverse support arm 166 is pivotally mounted, each arm 166 carrying a rotary radial wire roughing brush 168. The inner end of each support arm 166 has a link 170 pivotally connected thereto, the opposite end of each link 170 having formed therein a slot 171 in which is received a pin 173, whereby pivotal movement of the arm 166 about the shaft 164 is limited. Apart from the weight of the brush 168 urging the slotted end of its associated link 170 downwardly to a limit determined by the pin 173, resilient means, constituted by a pneumatically controlled piston-and-cylinder arrangement 175, is provided, a piston rod 177 of which is pivotally connected to the arm 166, said arrangement 175 being effective, when actuated, to urge the link downwardly relative to said pin.

Each pin 173 is mounted in a block 172, itself mounted for limited heightwise sliding movement on a front face of the cross-beam 156. The block 172 threadedly receives a threaded shaft 180 coupled, via a universal coupling 182, to the output drive shaft of a numerically controlled motor (as herein defined), constituted by a stepping motor 186, supported on the cross-beam 156. Operation of the stepping motor 186 is thus effective to cause the block 172 to be moved heightwise relative to the cross-beam 156, thus to shift the defined heightwise position of each tool 168, as determined by engagement between each pin 173 and the upper end of its associated slot 171. The distance through which such shifting takes place is pre-determined. The stepping motor 186 is operated each time a brush grinding operation takes place, as will be referred to hereinafter.

The tool carrier is mounted for pivotal movement on the fulcrum pins 154, thus to cause the roughing brushes 168 to be tilted bodily therewith about the axis of the fulcrum pins 154. In this way, the plane of each radial brush can be maintained perpendicular, or substantially so, to the plane of the area of the shoe bottom at the time being operated upon. For effecting pivotal movement of the tool carrier about the fulcrum pins 154, furthermore, a further numerically controlled motor (as herein defined), constituted by a stepping motor 232, is provided, which acts through a rod 204 which in turn is pivotally connected to an upstanding bracket on the cross-beam 156.

Furthermore, the shoe bottom engaging portion of the operating surface of each tool 168 is maintained, by successive grinding operations, such that it lies tangentially, or substantially so, to the plane in which the axis of the fulcrum pins 154 is disposed, when the brushes are in contact with the shoe bottom. In this way, the pivotal movement of the brushes about said axis does not significantly affect the position of the shoe bottom engaging portion of the operating surface of each tool lengthwise, heightwise and widthwise of the shoe bottom.

The roughing brushes 168 are caused to rotate in contrary directions such that each brush, as it is caused to operate progressively along a marginal portion of the shoe bottom, effects an inwiping action on such marginal portion. To this end, an electric motor 300 mounted on the base 10 of the machine is provided, which operates through a system of drive belts and drive pulleys, as described in greater detail in the aforementioned EPC Patent Specification. Said system comprises, for each brush, a pulley 246, mounted on the shaft 164, said pulley being operatively connected to the spindle of the roughing brush 168 by a drive belt 244, over a tensioning pulley 266 carried on the arm 166. By mounting the pulley 246 on the shaft 164, the final drive to the roughing brush 168 will not be affected by any pivotal movement of the arm 166 about said shaft 164.

The machine in accordance with the invention is computer-controlled, the computer having a storage member for storing digitized information relating to a number of selected styles of shoe bottom to be operated upon, the operator selecting the appropriate style for the particular shoe to be operated upon for the next cycle of operation; such selection may be through a keyboard (not shown) of the computer. Instead of storage in the computer memory, the digitized information may be stored on a suitable information-carrying medium, e.g. magnetic tape. In such a case, selection of a given style will of course require the appropriate medium to be placed in a reader of the computer. The term "programmed instruction" when used herein is intended to include digitized information particular to a given shoe style, regardless of the manner of its storage.

The computer is effective, in response to the programmed instruction selected, to cause the tool carrier to follow a pre-determined path with reference to three co-ordinate axes relative to the shoe support. Thus, for each digitized point, the computer supplies drive signals, in the form of control pulses, to the appropriate stepping motor 144, whereby its associated shoe support 18 is caused to move the shoe bottom beneath the brushes 168, while simultaneously, drive signals, also in the form of control pulses, are supplied to the second and third stepping motors for effecting movement of the tool support both widthwise and heightwise of the path of lengthwise movement of the shoe support. Similarly, the computer may supply drive signals, in the form of control pulses, to the stepping motor 232, whereby the tool support is caused to pivot about the axis of the fulcrum pins 154 as aforementioned. In the case of each stepping motor, furthermore, the control pulses are generated and supplied thereto in accordance with a programmed instruction, including digitized co-ordinate axis values, using three co-ordinate axis values, for a plurality of successive selected points along the marginal portion to be operated upon, such digitized information being stored in the memory of the computer.

The various stepping motors of the machine and also the computer control means thereof may also be utilized for determining the operative path of the tool carrier in relation to the shoe support. To this end, a model shoe is placed in one of the shoe supports 18 and relative lengthwise, widthwise and heightwise movement is effected between the tool carrier and the shoe support, spaced points of contact being selected between a brush 168 carried by the tool carrier and the shoe bottom supported by the shoe support, and the co-ordinate axis values of each such selected point being caused to be digitized using the computer control means and to be thereafter stored in the memory of such computer. The method used for determining the path of the tool carrier relative to the shoe support using the machine in accordance with the invention is generally similar, except as hereinafter described, to the method described in our co-pending EPC Patent Specification No. 81302394.2. Similarly, the machine also comprises operator controlled means, including a manually operable control device, generally as described in the last-mentioned Patent Specification, for effecting relative lengthwise, widthwise and heightwise movement between the tool carrier and the shoe support.

Figure 2:
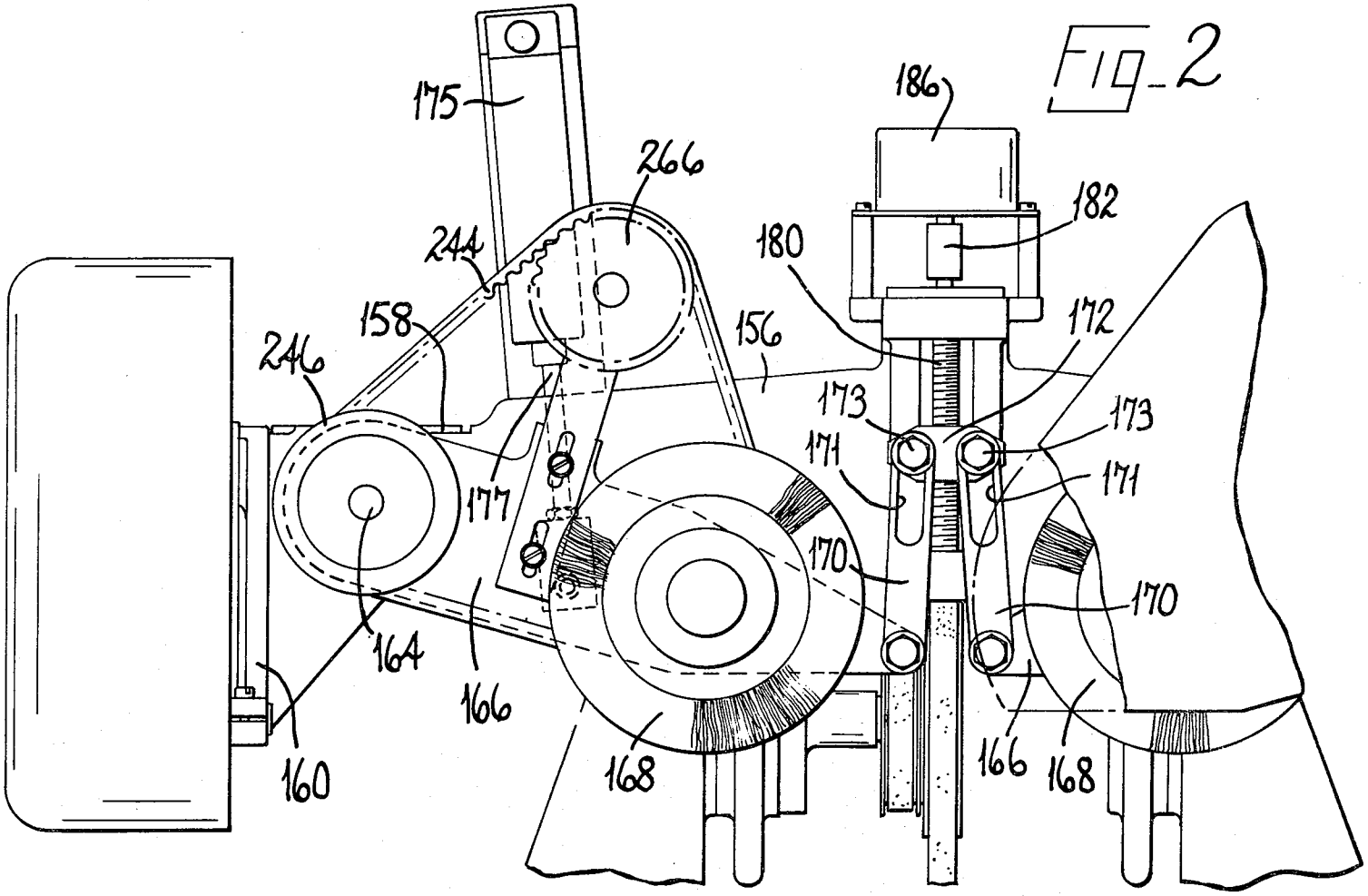
FIG. 2 is a front view, with parts broken away, showing two rotary radial roughing tools and support means therefor.

It will be appreciated that, in the machine in accordance with the invention, the heightwise position of each tool 168 relative to the tool carrier is not fixed, but rather the tool 168 may "float" heightwise in relation to the carrier, thus to accommodate any irregularities in the shoe bottom being operated upon, as compared with the digitized pre-determined path. In using the machine in accordance with the invention for digitizing such path, therefore, it is considered necessary that the heightwise disposition of each tool 168 relative to the tool carrier be known and to this end, in a path-determining mode of the machine, each piston-and-cylinder arrangement 175 is effective to urge its associated tool 168 to move relative to the tool carrier in a direction extending heightwise relative to the shoe support into a defined heightwise position in relation to the tool carrier, such position being determined by engagement by the pin 173 with one end of its associated slot 171 (as shown in FIG. 2). Furthermore, in the machine in accordance with the invention, sensing means (not shown) is also provided, operable in the path-determining mode of the machine, for sensing when the tool is in said defined heightwise position. Such sensing means comprises a fluidic bleed device which is closed when the pin 173 is in engagement with said one end of the slot 171, and which is opened as soon as the pin moves out of such position. The fluidic bleed device, furthermore, is effective to operate an indicator lamp which is visible by the operator, so that he can readily detect when the tool is in its defined heightwise position.

In using the machine in accordance with the invention for digitizing purposes, therefore, with a shoe placed in the shoe support, the shoe support is moved to a start position, which is such as to bring the leading, i.e. heel, end of the shoe bottom to a position beneath the selected brush 168, whereafter the latter is lowered into engagement with the shoe bottom under the control of the operator. When the brush engages the shoe bottom, it will be displaced from its defined heightwise position and this will be indicated by the indicator lamp. The operator can then adjust the heightwise position, prior to operating a "teach" button, whereby the co-ordinate axis values for the three-co-ordinate axes are digitized and stored. Operation of the "teach" button is also effective to raise the brush out of engagement with the shoe bottom and to effect a pre-determined amount of lengthwise movement of the shoe support relative to the shoe, as fully described in EPC Patent Specification No. 81302394.2. By maintaining the tool in its defined heightwise position for the digitizing of the first selected point, any possibility of the brush, as it approaches the shoe bottom in the operating mode of the machine, engaging with the shoe upper above the feather line, and thereby roughing in a region which will be visible in the finished shoe, can be avoided.

At the next selected point, the operator then, using the manually operable device, lowers the brush into engagement with the shoe bottom and also moves it widthwise according to the shoe bottom contour, such operator-controlled movement also causing compensatory lengthwise movement of the shoe support to take place so as to maintain the pre-determined distance between the point being digitized and the previous point to have been digitized, as described fully in EPC Patent Specification No. 81302394.2. When, as a result of the heightwise movement, the indicator lamp indicates that the tool has been moved out of its defined heightwise position, the operator then causes further heightwise movement of the tool carrier to take place through a pre-determined number of steps, say 50, of the stepping motor, so that the tool 168 is moved to a position in which the pin 173 is disposed approximately centrally of the slot 171. The operator then operates the "teach" button, and the set of co-ordinate axis values is again digitized, the tool then being moved through a further pre-determined distance, out of engagement with the shoe bottom in readiness for the next point to be digitized.

Digitizing of each successive point then takes place as aforesaid up to the toe end of the shoe, with the brush in a "floating" relationship with the tool carrier. In order to avoid any "over-roughing" at the toe end of the shoe, the final selected point may again be digitized with the tool in its defined heightwise position.

Instead of the operator himself controlling the amount of heightwise displacement of the tool carrier after the indicator lamp has indicated contact with the shoe bottom by the tool, in a modification of the machine in accordance with the invention the computer control means may be so arranged that the operator merely locates the shoe in relation to the shoe bottom with the tool retained in its defined heightwise position, and thereafter operation of the "teach" button is effective first to lower the tool carrier through a pre-determined distance and thereafter to initiate digitizing.

The piston-and-cylinder arrangements 175 whereby downward pressure is applied to the tools 168 as aforesaid are connected to variable pressure regulating means (not shown), comprising a plurality of sub-circuits each comprising a variable pressure regulator. Furthermore, in accordance with the programmed instruction for a given shoe style, the sub-circuits are selectively included in the main pneumatic circuit for the piston-and-cylinder arrangements 175 so that, as a tool 168 is caused to operate progressively along the marginal portion of a shoe bottom, the pressure applied thereby to the shoe bottom can be varied under the control of the resilient means. Such variation in applied pressure may be desirable e.g. where the upper is made up of different types or qualities of material which responsd differently to the roughing operation.

In order to ensure that the brushes 168 are maintained in a suitable sharpened condition for roughing, the machine in accordance with the invention also comprises grinding means, comprising two grinding stones (not shown) but referred to by reference numeral 630 in our co-pending EPC Patent Specification No. 81302395.9, one for each brush, the stones being arranged side-by-side and spaced apart by the same, or substantially the same, spacing as between the roughing brushes 168. The grinding stones are caused to rotate in contrary directions to one another, the direction of rotation in each case being such that, when engaged by a rotating roughing brush 168, the operating surface of each stone is moving in the same direction as the operating surface of the roughing brush engaged thereby, but at a greatly increased speed.

When a grinding operation takes place, the arm 30 is caused to pivot about its vertical axis to bring the roughing brushes into opposed relationship with the grinding stones, and thereafter said arm pivots about its horizontal axis to lower the brushes into proximity (or engagement, according to the amount of brush wear since the previous grinding operation) with the grinding stones, such that the uppermost portion of the operating surface of each stone lies in the plane in which the axis of the fulcrum pins 154 lies. In order to ensure that the brushes, when ground, are of uniform diameter, the stepping motor 186 is actuated to cause the brushes 168 to be moved downwardly, through a relatively small "grinding" distance, relative to the arm 30. In this manner, it will be appreciated, the grinding stones will grind way any portion of the operating surface of the operating surface of each brush which projects beyond the datum plane in which the uppermost surface of the stone lies, thus to maintain the lowermost portion of the operating surface of each brush in said datum plane.

It will be appreciated that, with the brushes having a "floating" facility, if the brushes are now urged against the stones, the tendency will be for the brushes to yield upwardly, against the action of the piston-and-cylinder arrangements 175. To counter any such upward movement, therefore, in a grinding operation increased pressure, e.g. full main line pressure, is applied to said arrangements 175, whereby the links 170 are held with the pins 173 at the upper end (viewing FIG. 2) of their respective slots 171.

In a modification of the machine in accordance with the invention, on the other hand, the brushes, when subjected to pressure from the grinding stones, may be caused to yield upwardly to an extent allowed by the slots 171, the arrangement being such that such upward movement is limited by engagement of each pin 173 with the lower end of its associated slot 171, the tool thus being moved to a second defined heightwise position, determined by the pins 173 in engagement with the lower end of the slots 171, for the grinding operation. Again, in a further modification of the machine in accordance with the invention, if desired each brush may be moved to a second heightwise position for grinding purposes, in which position each pin 173 is located centrally of its slot 171, which position of course defines the optimum operating position of the tool in the operating mode of the tool. Such a second defined heightwise position may be achieved in any conventional way, whether pneumatically or mechanically.

We claim:

1. A machine suitable for operating progressively along marginal portions of shoe bottoms, comprising:

a shoe support;

a tool carrier;

means for effecting relative movement, both lengthwise and widthwise of the bottom of a shoe supported by the shoe support, between the shoe support and the tool carrier;

means for controlling the heightwise position of the tool carrier relative to the shoe support, as relative lengthwise and widthwise movement is caused to take place therebetween, so that, in an operating mode of the machine, the tool carrier can follow a pre-determined path, determined according to the contour of the shoe bottom being operated upon, relative to the shoe support, a tool carried by the tool carrier can thus be caused to operate progressively along a marginal portion of the bottom of a shoe supported by the shoe support, wherein the tool is mounted on the tool carrier for limited movement relative thereto in a direction extending heightwise relative to the shoe support, wherein the means for effecting relative lengthwise and widthwise movement between the shoe support and tool carrier comprises first and second numerically controlled motors, and the means for controlling the heightwise position of the tool carrier relative to the shoe support comprising a third numerically controlled motor, each such motor operating under the control of computer control means by which drive signals are generated and supplied to said motors in accordance with a programmed instruction, including digitized co-ordinate axis values, using three co-ordinate axes, for a plurality of selected points along the marginal portion of the bottom of the or a similar shoe, and wherein path-determining means is provided which is operable in a path-determining mode of the machine, and which comprises a manually operable control device for causing relative movement to take place along said three co-ordinate axes between the shoe support and tool carrier to bring them to successive selected points along the marginal portion of the bottom of a shoe supported by the shoe support, and means for digitizing, and storing in digitized form, the co-ordinate axis values of each such selected point;

and further wherein resilient means is provided for urging the tool to move relative to the tool carrier in a direction extending heightwise relative to the shoe support into a defined heightwise position in relation to the tool carrier, sensing means also being provided, operable in the path-determining mode of the machine, for sensing when the tool is in said defined heightwise position.

2. A machine according to claim 1, wherein the resilient means is effective to urge the tool in a direction towards the shoe support and further wherein, in the operating mode of the machine, the tool is displaced, against the action of the resilient means, out of its defined heightwise position in relation to the tool carrier, and thus the pressure applied to a shoe bottom by the tool, as its operates progressively along a marginal portion of such shoe bottom, is controlled by the resilient means.

3. A machine according to claim 2, wherein, in the path-determining mode, each selected point is determined in relation to the defined heightwise position of the tool, the tool carrier therefter being moved heightwise through a distance to displace the tool from its defined heightwise position prior to the co-ordinate axis values of the selected point being digitized.

4. A machine according to claim 2, wherein, in the path-determining mode of the machine, the co-ordinate axis values for a selected point are digitized with the tool in its defined heightwise position, while in the operating mode thereof the pre-determined path of the tool carrier relative to the shoe support is transposed heightwise in relation to, and towards, the shoe support.

5. A machine according to claim 4 wherein the resilient means is fluid pressure operated and comprises variable pressure regulating means, the arrangement being such that the pressure applied to a shoe bottom by the tool is controlled by the pressure regulating means, and further wherein means is provided whereby the pressure controlled by said regulating means, and thus also the pressure applied as aforesaid to the shoe bottom, can be varied during the progressive operation of the tool along the marginal portion of the shoe bottom as aforesaid.

6. A machine according to claim 5, wherein the sensing means causes indicator means to be operated whereby a signal is provided, visible by the operator, when the tool is in its defined heightwise position and when moved therefrom.

7. A machine according to claim 6, wherein the sensing means is of the fluidic type.

8. A machine according to claim 6, wherein the tool is a rotary tool carried on an arm which is supported on the tool carrier for pivotal movement about an axis extending generally lengthwise of the shoe bottom and on which the resilient means is arranged to act, belt drive means being provided for rotating the tool, including a pulley mounted for rotation about said axis.

9. A machine according to claim 8, wherein grinding means is provided whereby the operating surface of the tool can be ground, and further wherein means is provided for shifting the defined heightwise position of the tool in relation to the tool carrier through a pre-determined distance each time a grinding operation takes place.

10. A machine according to claim 9, wherein the shifting means comprises a numerically controlled motor.

11. A machine according to either one of claims 9 and 10, wherein during the grinding operation the tool is held in its defined heightwise position by the resilient means, acting under increased pressure.

12. A machine according to either one of claims 9 and 10, wherein during the grinding operation the tool is moved into a second defined heightwise position spaced from said first-mentioned defined heightwise position.

13. A machine according to claim 12, wherein the end of the arm remote from its axis of pivot is connected to the tool carrier by a pin-and-slot connection, which thus defines the first-mentioned and second defined heightwise positions of the tool in relation to the tool carrier.

14. A machine according to claim 13, wherein the tool is in the form of a radial roughing brush.

15. A machine according to claim 14, wherein the tool carrier is mounted for pivotal movement about an axis extending widthwise of the shoe bottom, and wherein the tool is so arranged that said axis extends tangentially, or substantially so, to the shoe bottom engaging portion of its operating surface, when the tool is in contact with the shoe bottom being operated upon.

16. A machine according to claim 15, wherein means including a numerically controlled motor, is provided for effecting pivotal movement of the tool carrier about said axis as the tool is caused to operate progressively along the marginal portion of the bottom of a shoe, said motor also operating under the control of computer control means in response to drive signals generated and supplied thereto by said computer control means in accordance with a programmed instruction.

17. A machine according to claim 16, wherein the tool carrier is arranged to support two tools side-by-side, one of which is arranged to operate along the marginal portion of the shoe bottom at one side thereof during relative lengthwise movement between the shoe support and tool carrier in one direction, and the other at the opposite side thereof during such relative lengthwise movement in an opposite direction.

18. A machine according to claim 17, wherein the shoe support is mounted for movement lengthwise of the bottom of a shoe supported thereby, under the control of the first numerically controlled motor, and the tool carrier is mounted for movement both widthwise and heightwise of the path of movement of the shoe support under the control of respectively the second and third numerically controlled motors.

19. A machine according to claim 18, wherein the shoe support is mounted for pivotal movement about an axis extending widthwise of the bottom of a shoe supported thereby.

* * * * *